US010240407B2

(12) United States Patent
Morris et al.

(10) Patent No.: US 10,240,407 B2
(45) Date of Patent: Mar. 26, 2019

(54) METHOD AND SYSTEM FOR WIRELINE INTERVENTION IN A SUBSEA WELL FROM A FLOATING VESSEL

(71) Applicant: SHELL OIL COMPANY, Houston, TX (US)

(72) Inventors: Colin James Innes Morris, Tarn (FR); Martin Buchan, Perth (AU); David Russ Larimore, Dallas, TX (US); Nivea Boechat Dos Santos Gloria, Rio de Janeiro (BR); Gustavo Dias De Castro Cervo, Rio de Janeiro (BR); Scott Winfield Davis, Houston, TX (US); Scott Alistair Gordon, Frisco, TX (US); Mark James Klein, Rio de Janeiro (BR); Marc Gerard Paquette, Houston, TX (US)

(73) Assignee: Shell Oil Company, Houston, TX (US)

( * ) Notice: Subject to any disclaimer, the term of this patent is extended or adjusted under 35 U.S.C. 154(b) by 557 days.

(21) Appl. No.: 14/369,392

(22) PCT Filed: Dec. 19, 2012

(86) PCT No.: PCT/US2012/070672
§ 371 (c)(1),
(2) Date: Jun. 27, 2014

(87) PCT Pub. No.: WO2013/101601
PCT Pub. Date: Jul. 4, 2013

(65) Prior Publication Data

US 2015/0176346 A1 Jun. 25, 2015

Related U.S. Application Data

(60) Provisional application No. 61/581,193, filed on Dec. 29, 2011.

(30) Foreign Application Priority Data

Dec. 30, 2011 (EP) ..... 11196263

(51) Int. Cl.
*E21B 19/02* (2006.01)
*E21B 19/00* (2006.01)
(Continued)

(52) U.S. Cl.
CPC ..... *E21B 19/006* (2013.01); *E21B 17/003* (2013.01); *E21B 17/01* (2013.01);
(Continued)

(58) Field of Classification Search
CPC ..... E21B 19/002; E21B 19/004; E21B 19/006
(Continued)

(56) References Cited

U.S. PATENT DOCUMENTS 2,809,436 A 10/1957 Worthington et al.
3,650,323 A 3/1972 Kanady
(Continued)

FOREIGN PATENT DOCUMENTS

EP 1070828 A2 1/2001
GB 2292760 A 3/1996

OTHER PUBLICATIONS

PCT International Search Report, Application No. PCT/US2012/070672 dated Jan. 30, 2013.

*Primary Examiner* — Anna M Momper
*Assistant Examiner* — Patrick F Lambe

(57) ABSTRACT

A method for wireline intervention in a subsea well from a floating vessel.

10 Claims, 2 Drawing Sheets

(51) Int. Cl.

| | |
|---|---|
| ***E21B 47/01*** | (2012.01) |
| ***E21B 19/09*** | (2006.01) |
| ***E21B 19/15*** | (2006.01) |
| ***E21B 17/00*** | (2006.01) |
| ***E21B 17/01*** | (2006.01) |

(52) U.S. Cl.
CPC ..... *E21B 19/02* (2013.01); *E21B 19/09* (2013.01); *E21B 19/155* (2013.01); *E21B 47/011* (2013.01)

(58) Field of Classification Search
USPC ..... 166/345
See application file for complete search history.

(56) References Cited

U.S. PATENT DOCUMENTS

| | | | | |
|---|---|---|---|---|
| 4,695,191 | A * | 9/1987 | Wagstaff | B63B 27/24 166/338 |
| 6,216,789 | B1 | 4/2001 | Lorsignol et al. | |
| 2010/0104372 | A1 | 4/2010 | Lawson et al. | |
| 2011/0254234 | A1* | 10/2011 | Xu | F16J 15/062 277/644 |

* cited by examiner

METHOD AND SYSTEM FOR WIRELINE INTERVENTION IN A SUBSEA WELL FROM A FLOATING VESSEL

PRIORITY CLAIM

The present application is a National Stage (§ 371) application of PCT/US2012/070672, filed Dec. 17, 2012, which claims the benefit of U.S. Provisional Application No. 61/581,193, filed Dec. 29, 2011, and claims priority to European Patent Application No. 11196263.5, filed Dec. 30, 2011, both of which are incorporated herein by reference.

BACKGROUND OF THE INVENTION

The invention relates to a method and system for wireline intervention in a subsea well from a floating vessel.

U.S. Pat. No. 6,216,789 describes a method and system for wireline intervention in a subsea well from a floating vessel.

This prior art reference discloses a computer controlled heave compensation wireline logging winch system that compensates for the effects of wave motion on wireline tools suspended from floating vessels. Vessel vertical movement is measured and is physically compensated for by a change in speed of the wireline cable so that the logging data is obtained at a controlled speed. Any error in this physical compensation is detected by a depth measurement system and is used to adjust the true depth at which the logging tool measurements are being recorded.

There is a need to solve two problems associated with the method and system known from U.S. Pat. No. 6,216,789:

(1) Overcome the challenges for upending and overboarding a long, fragile and flexible wireline toolstring from the deck of a floating vessel; and (2) Accurately heave compensate the toolstring subsea in order to safely stab in the wireline tools into the subsea equipment and control at depth.

Traditionally, subsea well interventions are conducted from heavy-weight, mobile offshore drilling units (MODUs) with riser packages.

Unfortunately, these intervention operations demand substantial operating day rates.

Drilling units offers conventional means to assemble tool string in vertical position and stab in tools through riser packages, therefore heave compensation is usually not an issue. Apart from traditional rig interventions, rigless intervention have been carried out on light intervention vessels that also offers convention ways of assembly and deployment of toolstrings. On those types of vessel, heave compensation is sometimes incorporated to the derrick system itself.

Thus there is a need for an improved wireline intervention method that can be performed from any floating vessel and which does not require use of a large drilling vessel and which overcomes the challenges for upending and overboarding a long, fragile and flexible wireline toolstring from the deck of a floating vessel.

SUMMARY OF THE INVENTION

In accordance with the invention there is provided a method for wireline intervention in an subsea well from a floating vessel, the method comprising:

a) arranging a tubular tool riser in a substantially horizontal position at a deck of the vessel;

b) connecting a wireline assembly to a wireline that is connected to a winch arranged at the deck;

c) inserting the wireline assembly and pass the wireline through a first end of the tool riser into said riser such that the wireline passes along a riser sheave connected to the first end of the tool riser;

d) connecting the first end of the tool riser to a crane that lifts the tool riser in a substantially vertical position above the deck, whilst unreeling the wireline from the winch such that the wireline assembly remains located within the tool riser;

e) inducing the crane to move a second end of the tool riser above a guide sleeve which arranged and/or cantilevered off the side of the vessel;

f) inducing the crane to lower the tool riser through the guide sleeve such that the second end of the tool riser is located subsea and the first end of the tool riser and the riser sheave are located above the deck; and g) inducing a crane heave compensation mechanism to control the motion of the tool riser and riser sheave relative to the seafloor while unreeling the wireline from the winch such that the wireline assembly is lowered from the tool riser through the water into the well.

The first end of the tool riser may be connected by a hoisting cable to a hook which is connected to a single fall line of the crane and the crane heave compensation mechanism is configured to maintain the hook substantially stationary relative to the seafloor, thereby providing heave compensation to the wireline assembly.

Alternatively, the wireline passes through a deck sheave which is connected to the deck adjacent to the sleeve and the hook is connected to a hoisting sheave which is connected by a double fall crane line to the crane and the heave compensation mechanism is configured to substantially halve reduce heave motion of the hook relative to heave motion of the vessel and inducing the deck sheave and riser sheave to provide heave compensation to the wireline assembly.

In accordance with the invention there is further provided a system for wireline intervention into an subsea well from a floating vessel, the system comprising:

a) a floating vessel having a deck configured to support a tubular tool riser in a substantially horizontal position;

b) a winch at the deck which is configured to be connected to a wireline and wireline assembly;

c) means for inserting the wireline assembly and part the wireline through a first end of the tool riser into said riser such that the wireline passes along a riser sheave connected to the first end of the tool riser;

d) a crane that is configured to be connected to the first end of the tool riser and to lift the the tool riser in a substantially vertical position above the deck, whilst unreeling the wireline from the winch such that the wireline assembly remains located within the tool riser;

e) means for inducing the crane to move a second end of the tool riser above a guide sleeve which is connected to a side wall of the vessel adjacent to the deck;

f) a crane control mechanism for inducing the crane to lower the tool riser through the guide sleeve such that the second end of the tool riser is located subsea and the first end of the tool riser and the riser sheave are located above the deck; and g) a crane heave compensation mechanism for controlling the motion of the tool riser and riser sheave relative to the seafloor while unreeling the wireline from the winch such that the wireline assembly is lowered from the tool riser through the water into the well.

These and other features, embodiments and advantages of the method and/or system according to the invention are described in the accompanying claims, abstract and the following detailed description of non-limiting embodiments depicted in the accompanying drawings, in which description reference numerals are used which refer to corresponding reference numerals that are depicted in the drawings.

Similar reference numerals in different figures denote the same or similar objects.

DETAILED DESCRIPTION OF THE DEPICTED EMBODIMENTS

Figure 1:
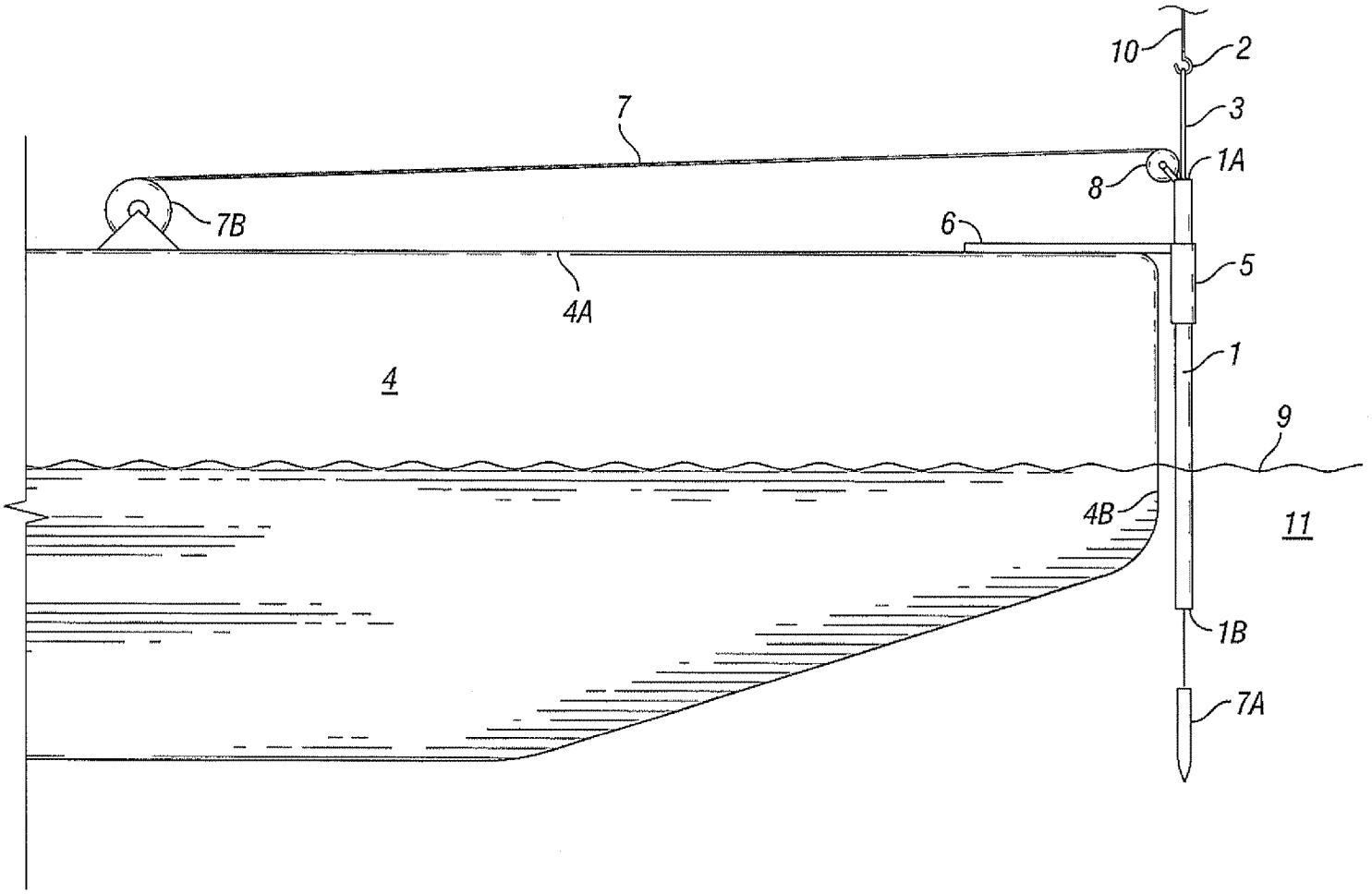
FIG. 1 is a schematic side view of a first embodiment of a system according to the invention.
Figure 2:
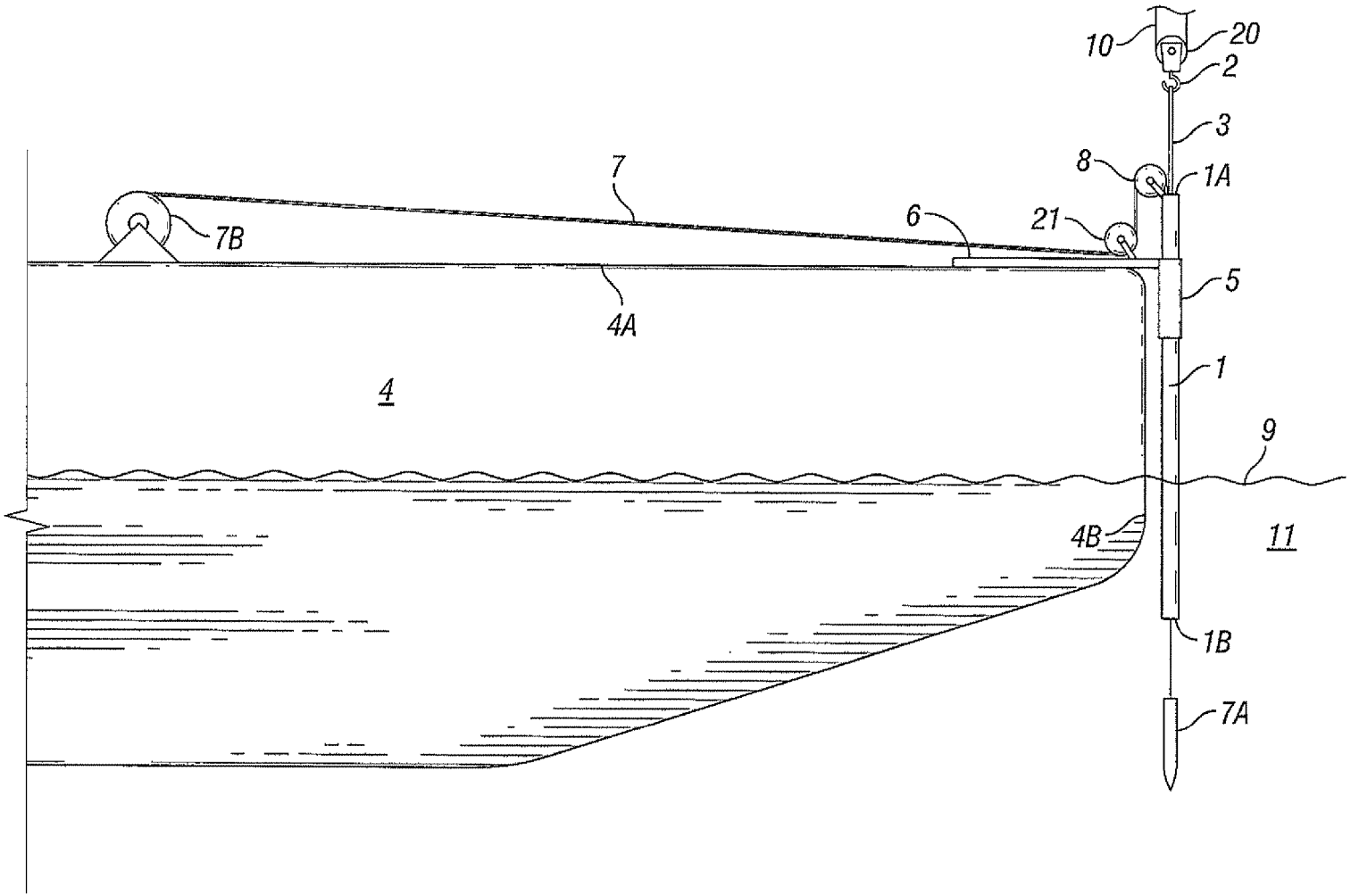
FIG. 2 is a schematic side view of a second embodiment of a system according to the invention.

The system according to invention shown in FIGS. 1 and 2 includes the following two inventive features I and II:

I) The tool riser 1, which is a long joint of pipe with a quick connection flange welded to the first end of the riser 1A and a bevelled opposite end (second end of the riser 1B). The tool riser 1 provides a means for the wireline toolstring 7A to be assembled in horizontal position into the tool riser 1 with the support of a work table, safely upended from horizontal to vertical position and finally deployed subsea. As soon as the tools are assembled and secured to the toolstring 7A they are inserted into the tool riser 1 through a quick connection flange at a first end 1A of the tool riser 1. Then the tool riser 1 is upended using a crane hook 2 and dedicated slings 3 connected to the first end 1A of the tool riser 1. This upending method does not offer any risk or damage to the tool strings 7A to be deployed.

II) The tool riser 1 is suspended by an active heave compensated crane hook 2 of a crane (not shown) mounted on the deck 4A of a floating vessel 4. When the heave compensation system on the crane is activated, the tool riser 1 is raised and lowered relative to the deck 4A of the floating vessel 4 keeping the tool string stationary relative to the seafloor, effectively isolating vessel motions from the tool string. As the wireline 7, which may comprises power and control cables or be a slickline without power and control cables, passes through the riser sheave 8 on the tool riser 1, compensation is transferred to the wireline 7.

The tool riser 1 moves up and down through a guide sleeve 5 attached to a work platform 6 cantilevered off the side 4B of the vessel 4. The sleeve 5 allows vertical motion of the tool riser 1, but prevents motion of the tool riser 1 in the horizontal plane. The arrangement of the tool riser 1 through the sleeve 5 prevents the tool riser 1 and crane hook 2 from swinging uncontrollably due to oscillating motions of the vessel 4 due to waves, wind and/or current.

The tool riser 1 extends through the splash zone 9 into the water 11, which may be a sea, ocean or lake to protect the fragile toolstring 7A from damage due to wave action at the water surface.

There are two possible sheave arrangements that can be utilized depending on available deck space on the vessel 4 of opportunity.

FIG. 1 shows the simple sheave arrangement, which arrangement requires more deck area than the more complex sheave arrangement shown in FIG. 2.

Wireline operations on traditional drilling rigs compensate the toolstring 7A in a similar manner.

In FIG. 1, the crane hook 2 is suspended from a single fall crane line and is attached to the tool riser 1 by the slings 3 and operated in conventional heave compensation mode. The distance from the wireline winch 7B to the riser sheave 8 connected to the first end 1A of the tool riser 1 must be sufficient that when the tool riser 1 moves up and down with the crane hook 2 the change in distance between the wireline winch 7A and the tool riser 1 is negligible.

FIG. 2 shows an alternate sheave arrangement which has been successfully used for an offshore well intervention. The crane hook 2 is connected to a double fall block 20, but the heave compensation system of the crane is operated in single fall mode. Therefore, the crane block 20 and hook 2 are only moving up and down half as much as they would normally move when the heave compensation system is activated. The movement on the crane block 20 and hook 2 is then multiplied by a factor of two with the sheave arrangement of a fixed sheave 21 on the work platform 6 and the riser sheave 8 on the tool riser 1, and the toolstring 7A is properly heave compensated at the seafloor. This arrangement can be used when there is a limited horizontal distance between the wireline winch 7B and the tool riser 1.

It allows wireline operations to be performed from any vessel 4 of opportunity equipped with an active heave compensated crane hook 2 using a conventional wireline winch.

The invention claimed is:

1. A method for wireline intervention in a subsea well from a floating vessel, the method comprising:

a) arranging a tubular tool riser in a substantially horizontal position at a deck of the vessel;

b) connecting a wireline assembly to a wireline that is connected to a winch arranged at the deck;

c) inserting the wireline assembly and passing the wireline through a first end of the tubular tool riser such that the wireline passes along a riser sheave connected to the first end of the tubular tool riser;

d) connecting the first end of the tubular tool riser to a crane that lifts the tubular tool riser in a substantially vertical position above the deck, whilst unreeling the wireline from the winch such that the wireline assembly remains located within the tubular tool riser;

e) inducing the crane to move a second end of the tubular tool riser above a guide sleeve which is attached to a work platform cantilevered off a side of the vessel;

f) inducing the crane to lower the tubular tool riser through the guide sleeve such that the second end of the tubular tool riser is located subsea and the first end of the tubular tool riser and the riser sheave are located above the deck; and g) inducing a crane heave compensation mechanism to control the motion of the tubular tool riser and riser sheave relative to the seafloor while unreeling the wireline from the winch such that the wireline assembly is lowered from the tubular tool riser through the water into the subsea well.

2. The method of claim 1, wherein the first end of the tubular tool riser is connected by a hoisting cable to a hook which is connected to a fall line of the crane.

3. The method of claim 2, wherein the hook is connected to a single fall line of the crane and the crane heave compensation mechanism is configured to maintain the hook substantially stationary relative to the seafloor, thereby providing heave compensation to the wireline assembly.

4. The method of claim 2, wherein wireline passes through a deck sheave which is connected to the deck adjacent to the sleeve and the hook is connected to a hoisting sheave which is connected by a double fall crane line to the crane.

5. The method of claim 1, wherein the wireline assembly is inserted into the subsea well.

6. The method of claim 5, wherein the wireline assembly is first lowered into the subsea well and subsequently pulled up through the well at a predetermined speed by winching up the wireline while activating monitoring equipment in the wireline assembly.

7. A system for wireline intervention into a subsea well from a floating vessel, the system comprising:

a) a floating vessel having a deck configured to support a tubular tool riser in a substantially horizontal position;

b) a winch at the deck which is configured to be connected to a wireline and wireline assembly;

c) means for inserting the wireline assembly and passing the wireline through a first end of the tubular tool riser such that the wireline passes along a riser sheave connected to the first end of the tubular tool riser;

d) a crane that is configured to be connected to the first end of the tubular tool riser and to lift the tubular tool riser in a substantially vertical position above the deck, whilst unreeling the wireline from the winch such that the wireline assembly remains located within the tool riser;

e) means for inducing the crane to move a second end of the tubular tool riser above a guide sleeve which is attached to a work platform cantilevered off a side of the vessel;

f) a crane control mechanism for inducing the crane to lower the tubular tool riser through the guide sleeve such that the second end of the tubular tool riser is located subsea and the first end of the tubular tool riser and the riser sheave are located above the deck; and g) a crane heave compensation mechanism for controlling the motion of the tubular tool riser and riser sheave relative to the seafloor while unreeling the wireline from the winch such that the wireline assembly is lowered from the tubular tool riser through the water into the subsea well.

8. The system of claim 7, wherein the first end of the tubular tool riser is connected by a hoisting cable to a hook which is connected to a fall line of the crane.

9. The system of claim 8, wherein the hook is connected to a single fall line of the crane and the heave compensation mechanism is configured to maintain the hook substantially stationary relative to the seafloor, thereby providing heave compensation to the wireline assembly.

10. The system of claim 8, wherein wireline passes through a deck sheave which is connected to the deck adjacent to the sleeve and the hook is connected to a hoisting sheave which is connected by a double fall crane line to the crane.

* * * * *